US006857535B1

(12) United States Patent
Zuckerman

(10) Patent No.: US 6,857,535 B1
(45) Date of Patent: Feb. 22, 2005

(54) CONTAINER INTERLOCKING DEVICE

(75) Inventor: Edward S. Zuckerman, Denville, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 31 days.

(21) Appl. No.: 10/605,220

(22) Filed: Sep. 16, 2003

Related U.S. Application Data

(60) Provisional application No. 60/319,557, filed on Sep. 17, 2002.

(51) Int. Cl.[7] ..... B65D 21/02
(52) U.S. Cl. ..... 220/23.4; 220/23.6; 206/821
(58) Field of Search ..... 220/23.4, 23.6; 206/821, 508, 509, 503

(56) References Cited

U.S. PATENT DOCUMENTS 2,454,307 A * 11/1948 Burnell ..... 52/591.3
2,495,132 A * 1/1950 Roy ..... 220/23.4
3,219,182 A * 11/1965 Cornwell, Jr. ..... 206/503
3,458,035 A * 7/1969 Orthober ..... 206/431
4,422,549 A * 12/1983 Werkheiser ..... 206/386
5,413,236 A * 5/1995 Kenevan ..... 220/4.28
5,420,093 A * 5/1995 Joly et al. ..... 502/216
5,636,753 A * 6/1997 Wilkinson et al. ..... 211/59.4
5,772,038 A * 6/1998 Murata et al. ..... 206/725

* cited by examiner

*Primary Examiner*—Joseph Man-Fu Moy
(74) *Attorney, Agent, or Firm*—Robert Charles Beam; John F. Moran

(57) ABSTRACT

An interlocking device for use with rectangular containers, such as metal ammunition containers having a top lid, is shown. The interlocking device comprises a substantially flat plate, coextensive with the top lid of the containers, and having a set of locking tabs to attach to the top lid. The device also has a set of positioning tabs to engage the bottom of another container, when such containers are stacked. The device is attached to similar devices by a set of interconnection mechanisms, which may be male-female connectors located along each edge of the device, such that the interlocking mechanisms on the front and rear edges of the device are of opposite interlocking design and the locking mechanism on the front edge of one device will demountably interlock with the locking mechanism on the rear edge of another device. In addition, the interlocking mechanism on each lateral side edge of the device are of opposite interlocking design and the locking mechanism on one lateral edge of one device will demountably interlock with the interlocking mechanism on the opposite side of another device.

12 Claims, 4 Drawing Sheets

CONTAINER INTERLOCKING DEVICE

CROSS REFERENCE TO RELATED APPLICATIONS

This application claims benefit under 35 U.S.C. 199(*e*) of provisional application 60/319,557, filed Sep. 17, 2002, the entire file wrapper contents of which provisional application are herein incorporated by reference as though fully set forth at length.

FEDERAL RESEARCH STATEMENT

The invention described herein may be made, used, or licensed by or for the United States Government for Government purposes without the payment of any royalties thereon or therefore.

BACKGROUND OF INVENTION

1. Field of the Invention

The present invention relates to a device for the storage and protection of metal ammunition containers. In particular, the present invention relates to an interlocking device for rectangular containers, such as metal ammunition containers and the like, each of said containers having a top lid, a bottom, a front side, a back side and two lateral sides, wherein said interlocking device comprises:

- a substantially flat plate substantially coextensive with the top lid of one of said containers and having a front edge, a rear edge and two lateral edges;
- a plurality of locking tabs to demountably engage the top lid of one of said rectangular containers, said locking tabs depending from said flat plate and integrally formed with said flat plate;
- a plurality of positioning tabs to positionally engage the bottom of another container, said positioning tabs being integrally formed with said flat plate and rising above it;
- a plurality of interconnection mechanisms, located along each edge of said flat plate and integrally formed therewith, such that the at least one interlocking mechanisms on the front and rear edges of said flat plate are of opposite interlocking design and the at least one locking mechanism on the front edge of one device will demountably interlock with the at least one locking mechanism on the rear edge of another device, and the at least one interlocking mechanism on each lateral side edge of said flat plate are of opposite interlocking design and the at least one locking mechanism on one lateral edge of one device will demountably interlock with the at least one interlocking mechanism on the opposite side of another device.

2. Description of Related Art

Metal ammunition containers are currently packaged for shipping and storage in wire-bound wooden boxes. These boxes might be designed to hold a number of containers, depending upon the caliber of the ammunition and the size of the container, but boxes designed to hold two or four containers are common.

Use of these boxes has been common for many years, notwithstanding a number of problems which have been encountered. Among these problems is the weight and bulk of the boxes, which adds to the shipping costs and restricts the volume of ammunition which can be shipped in a standard container, or a truck, or the like. Further, the boxes are not suitable for re-use and represent a disposal problem when the ammunition containers are removed. The boxes, therefore, represent a re-occurring expense that adds to the cost of the ammunition.

Other difficulties have been encountered, since the boxes are combustible and will support a fire, they can be considered hazardous. They are also not able to be decontaminated after exposure to chemical hazards, such as chemical weapons like nerve gas.

The boxes make access to the ammunition containers difficult and time-consuming, and have not been shown to provide satisfaction protection to the metal containers.

SUMMARY OF INVENTION

Objects of the Invention

It is an object of the present invention to provide a way of packaging and shipping metal ammunition containers that will eliminate the weight and bulk of wooden shipping containers.

It is a further object of the present invention to provide a way of packaging and shipping metal containers that is less expensive, and which can be reused.

It is a still further object of the present invention to provide a way of packaging and shipping metal containers that is not itself combustible and which is capable of being decontaminated.

The other objects, features and advantages of the present invention will become more apparent in light of the following detailed description of the preferred embodiment thereof.

According to the present invention, there is provided an interlocking device for rectangular containers, such as metal ammunition containers and the like, each of said containers having a top lid, a bottom, a front side, a back side and two lateral sides, wherein said interlocking device comprises:

- a substantially flat plate substantially coextensive with the top lid of one of said containers and having a front edge, a rear edge and two lateral edges;
- a plurality of locking tabs to demountably engage the top lid of one of said rectangular containers, said locking tabs depending from said flat plate and integrally formed with said flat plate;
- a plurality of positioning tabs to positionally engage the bottom of another container, said positioning tabs being integrally formed with said flat plate and rising above it;
- a plurality of interconnection mechanisms, located along each edge of said flat plate and integrally formed therewith, such that the at least one interlocking mechanisms on the front and rear edges of said flat plate are of opposite interlocking design and the at least one locking mechanism on the front edge of one device will demountably interlock with the at least one locking mechanism on the rear edge of another device, and the at least one interlocking mechanism on each lateral side edge of said flat plate are of opposite interlocking design and the at least one locking mechanism on one lateral edge of one device will demountably interlock with the at least one interlocking mechanism on the opposite side of another device.

DETAILED DESCRIPTION

Figure 1:
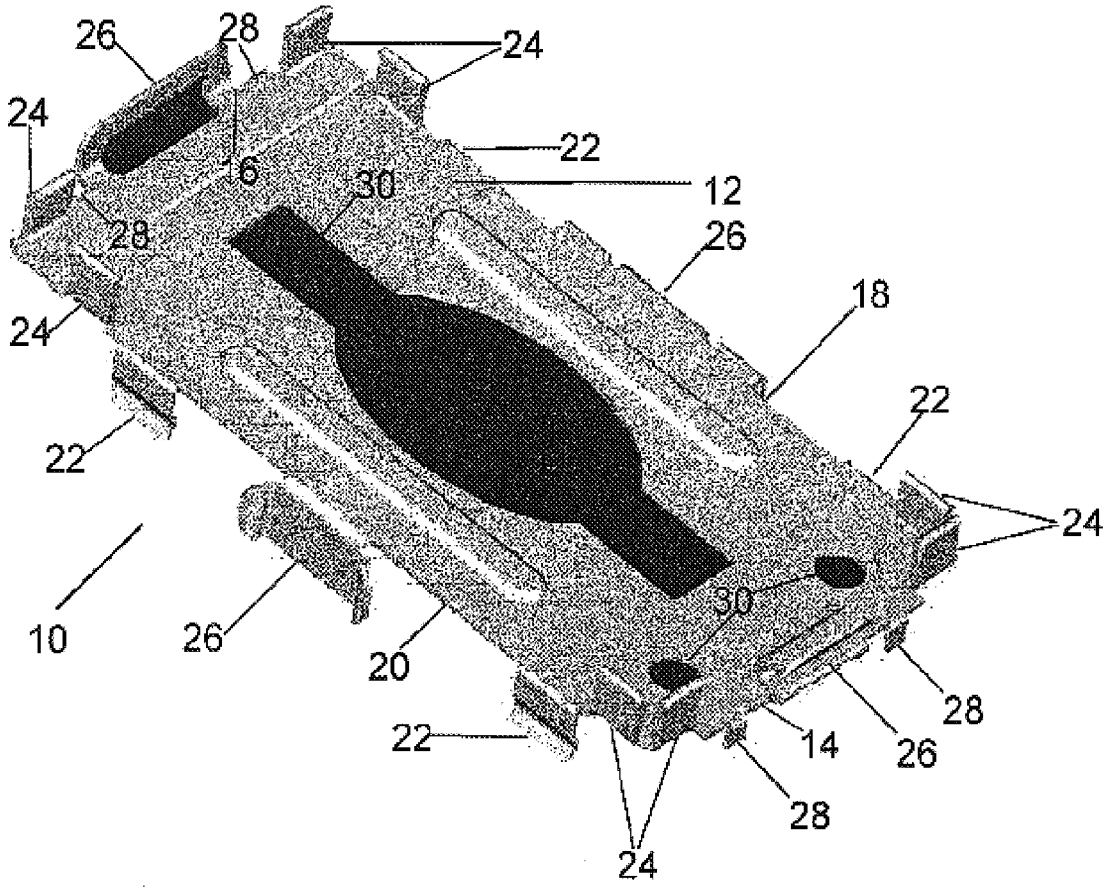
FIG. 1 shows the interlocking device of the present invention.

As shown in FIG. 1, the present invention provides an interlocking device 10 for rectangular containers, such as metal ammunition containers and the like, each of said containers having a top lid, a bottom, a front side, a back side and two lateral sides. This interlocking device 10 comprises a substantially flat plate 12 intended to be substantially coextensive with the top lid of one of the containers. This flat plate 12 has a front edge 14, a rear edge 16 and two lateral edges 18 and 20.

Figure 2:
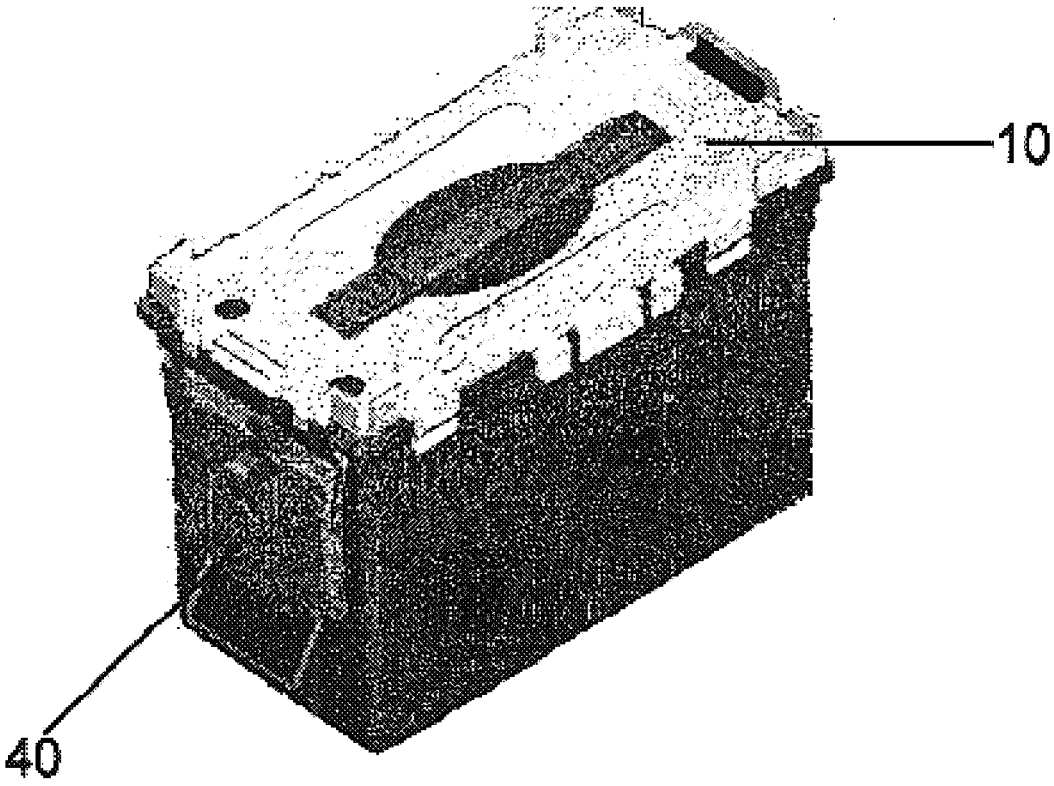
FIG. 2 shows the interlocking device of the present invention in place on a rectangular container, such as a metal ammunition container.

In addition, the flat plate 12 is further provided with a plurality of locking tabs 22 to demountably engage the top lid of one of said rectangular containers, and these locking tabs 22 depend from the flat plate 12 and are integrally formed with the flat plate 12. This feature is shown more clearly in FIG. 2, wherein the interlocking device 10 of the present invention is shown in place on a rectangular container, such as a metal ammunition container 40. With continued reference to FIG. 1, the flat plate 12 is also provided with a plurality of positioning tabs 24 to positionally engage the bottom of another container, these positioning tabs 24 being integrally formed with the flat plate 12 and rising above it.

Figure 3:
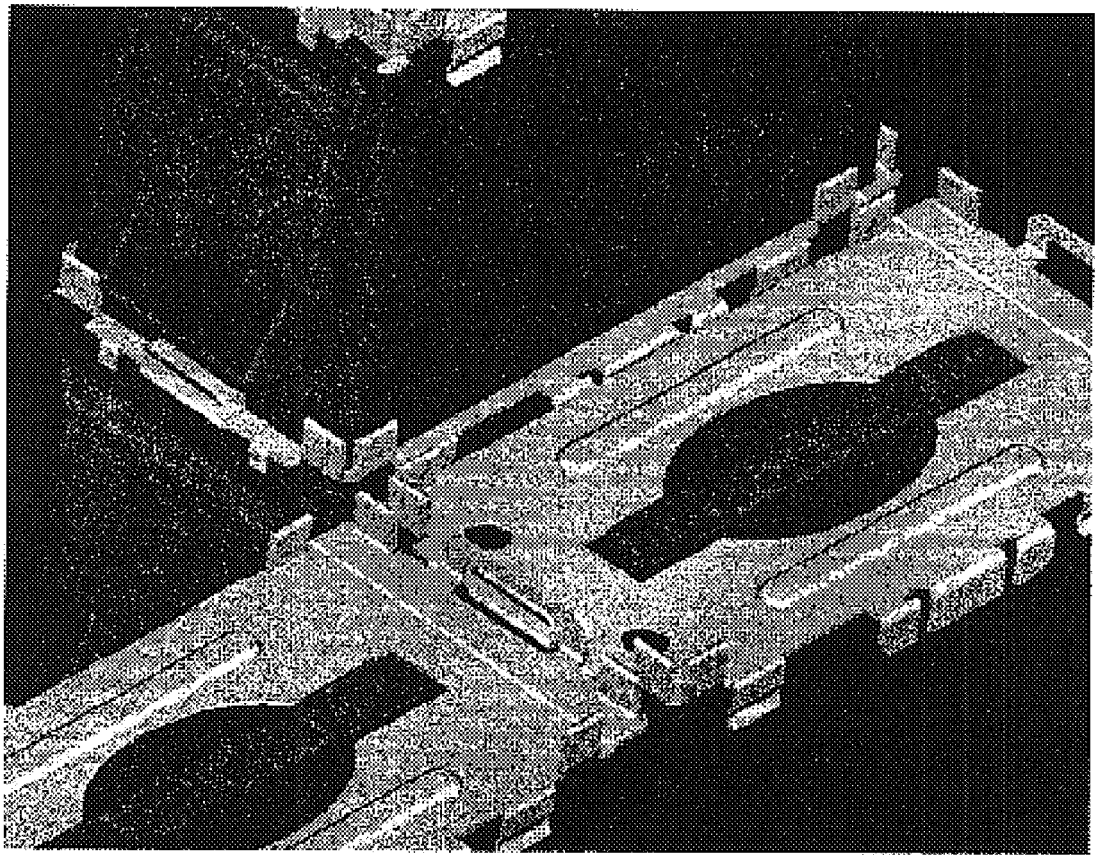
FIG. 3 shows a group of metal ammunition containers held into position with the interlocking devices of the present invention.

The interlocking device 10 of the present invention is further provided with a plurality of interconnection mechanisms 26, located along each edge of said flat plate 12 and integrally formed therewith. These interconnection mechanisms 26 are designed such that the at least one interlocking mechanisms 26 on the front edge 14 and the rear edge 16 of said flat plate 12 are of opposite interlocking design. Further, the at least one locking mechanism 26 on the front edge 12 of one device 10 will demountably interlock with the at least one locking mechanism 26 on the rear edge 16 of another device 10. In addition, the at least one interlocking mechanism 26 on a first lateral side edge 18 of the flat plate 12 and the interlocking device 26 on the second lateral edge 20 of flat plate 12 are of opposite interlocking design, and the at least one locking mechanism 26 on the first lateral edge 18 of one device 10 will demountably interlock with the at least one interlocking mechanism 26 on the second lateral and opposite side 20 of another device 10. And arrangement of the devices 10, each attached to a metal ammunition container 40, is shown in FIG. 3.

Figure 4:
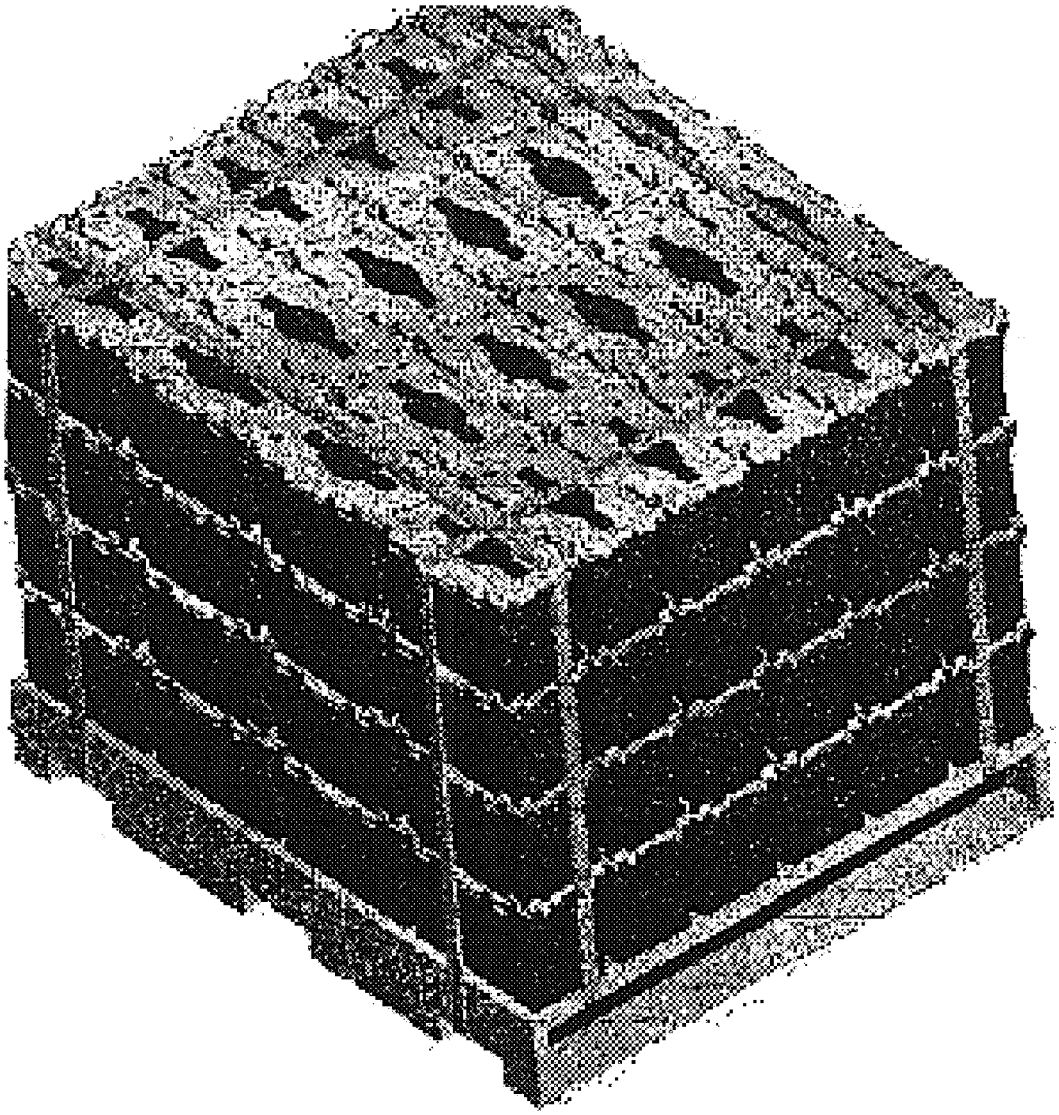
FIG. 4 shows a pallet loaded with metal ammunition containers held into position with the interlocking devices of the present invention.

In this way, a pallet 42 of metal ammunition containers 40 can be assembled using the interlocking device 10 of the present invention, as shown in FIG. 4.

The interlocking device 10 of the present invention can be constructed of any suitable material, such as vanadium steel, low carbon steel, spring steel, or another suitable metal and can be prepared by stamping or other suitable metalworking techniques. Alternatively, the interlocking device of the present invention may be constructed of an organic polymeric material, such as a thermoset resin, and can be prepared by blow-molding or other fabrication technique known to the art.

In the illustrated embodiment of FIG. 1, the locking tabs 22 are located on the lateral side edges 18 and 20 of the flat plate 12 of the interlocking device 10 of the present invention. One skilled in the art will recognize that locating these locking tabs in this way is a matter of choice, and these locking tabs 22 could be located on the front edge 14 and rear edge 16 as well. It has been found useful, however, that when such locking tabs 22 are not located on all sides of flat plate 12, locator tabs 28 are usefully provided on those edges which are not provided with locking tabs 22. In the illustrated embodiment, such locator tabs 28 are shown on the front edge 14 and rear edge 16 of the flat plate 12, and prevent forward and backward movement of the interconnection device 10 relative to a metal ammunition container 40.

The illustrated embodiment of the present invention utilizes male-female interconnection mechanisms 26. On skilled in the art will recognize that other connection methodologies are possible and are contemplated hereunder. Similarly, reversal of the orientation of the interconnection is within the scope of the present invention.

On skilled in the art will also recognize the positioning tabs 24 and other aspects of the interlocking device 10 will help to protect an attached metal ammunition container in use. Thus, the positioning tabs 24, in particular, will assist in protecting the integrity of the container in drop testing, which could damage the top lid of the container, and the hinge or locking mechanism interconnected with the top lid.

In addition, the interlocking device 10 of the present invention may be provided with one or more cut-out sections 30 to permit positioning upon to top lid of a container, or access to container elements, such as a handle, or the like.

Other features, advantages, and specific embodiments of this invention will become readily apparent to those exercising ordinary skill in the art after reading the foregoing disclosure. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. An interlocking device for rectangular containers, such as metal ammunition containers and the like, each of said containers having a top lid, a bottom, a front side, a back side and two lateral sides, wherein said interlocking device comprises:

a substantially flat plate substantially coextensive with the top lid of one of said containers and having a front edge, a rear edge and two lateral edges;

a plurality of locking tabs to demountably engage the top lid of one of said rectangular containers, said locking tabs depending from said flat plate and integrally formed with said flat plate;

a plurality of positioning tabs to positionally engage the bottom of another container, said positioning tabs being integrally formed with said flat plate and rising above it;

a plurality of interconnection mechanisms, located along each edge of said flat plate and integrally formed therewith, such that the at least one interlocking mechanisms on the front and rear edges of said flat plate are of opposite interlocking design and the at least one locking mechanism on the front edge of one device will demountably interlock with the at least one locking mechanism on the rear edge of another device, and the at least one interlocking mechanism on each lateral side edge of said flat plate are of opposite interlocking design and the at least one locking mechanism on one lateral edge of one device will demountably interlock with the at least one interlocking mechanism on the opposite side of another device.

2. The interlocking device of claim 1 wherein the flat plate is constructed of metal.

3. The interlocking device of claim 2 wherein the metal is vanadium steel.

4. The interlocking device of claim 2 wherein the metal is low-carbon steel.

5. The interlocking device of claim 2 wherein the metal is spring steel.

6. The interlocking device of claim 1 wherein the flat plate is formed of an organic polymeric material.

7. The interlocking device of claim 1 wherein said locking tabs are located on the lateral edges of said flat plate.

8. The interlocking device of claim 7 wherein said device further comprises a plurality of locator tabs to positionally engage the top of said container, said locator tabs being integrally formed with said flat plate and depending therefrom.

9. The interlocking device of claim 8 wherein said locator tabs are located on the front and rear edges of said flat plate.

10. The interlocking device of claim 1 wherein the interlocking design of said locking mechanisms are of male-female design.

11. The interlocking device of claim 1 wherein said positioning tabs have sufficient structural strength to aid an attached container's survival in drop tests.

12. The interlocking device of claim 1 wherein said flat plate is further provided with cut-away sections to permit positioning upon to top lid of a container, or access to container elements.

* * * * *